US012678664B2

(12) United States Patent
Deland

(10) Patent No.: US 12,678,664 B2
(45) Date of Patent: Jul. 14, 2026

(54) WEIGHTLIFTING SYSTEM AND METHOD FOR ANALYSING LIFT MOTION

(71) Applicant: Dominic Deland, Victoria Park (AU)

(72) Inventor: Dominic Deland, Victoria Park (AU)

( * ) Notice: Subject to any disclaimer, the term of this patent is extended or adjusted under 35 U.S.C. 154(b) by 936 days.

(21) Appl. No.: 17/947,108

(22) Filed: Sep. 17, 2022

(65) Prior Publication Data

US 2023/0078368 A1 Mar. 16, 2023

(30) Foreign Application Priority Data

Jul. 17, 2021 (AU) ..... 2021902204

(51) Int. Cl.
*A63B 24/00* (2006.01)
*A63B 21/072* (2006.01)
*A63B 71/06* (2006.01)

(52) U.S. Cl.
CPC ..... *A63B 24/0062* (2013.01); *A63B 21/072* (2013.01); *A63B 71/0622* (2013.01); *A63B 2024/0068* (2013.01); *A63B 2071/0655* (2013.01); *A63B 2208/02* (2013.01); *A63B 2220/80* (2013.01); *A63B 2244/09* (2013.01)

(58) Field of Classification Search
None
See application file for complete search history.

(56) References Cited

U.S. PATENT DOCUMENTS 5,271,416 A 12/1993 Lepley
7,666,118 B1 * 2/2010 Anthony ..... A63B 21/0724 482/8
2008/0242512 A1 * 10/2008 Kim ..... A63B 21/065 482/8
2012/0302406 A1 11/2012 Hinds et al.
2014/0152450 A1 6/2014 Hjort
(Continued)

FOREIGN PATENT DOCUMENTS

WO 2020/176773 A1 9/2020

OTHER PUBLICATIONS

Search Report for Application No. GB221366.2 dated Mar. 9, 2023 (1 page).

(Continued)

*Primary Examiner* — Jason T Yen
(74) *Attorney, Agent, or Firm* — Braxton IP PLLC; Bobby W. Braxton

(57) ABSTRACT

A system for monitoring the symmetry of a lifting stance, the system including: a platform for supporting a weightlifter during a lift, the platform including support plates which include load sensors; a processor in data communication with the one or more load sensors for receiving and processing weightlifter load data, the processor configured to assess weightlifter symmetry data against a symmetry threshold to provide a symmetry result; and an output module for informing the weightlifter of the symmetry result. Also described is a method for monitoring the symmetry of a lifting stance, including the steps of: receiving data from one or more load sensors on one or more support plates on a weightlifting platform to process weightlifter load data; processing weightlifter load data to provide weightlifter symmetry data; assessing weightlifter symmetry data against a symmetry threshold to provide symmetry result data; and displaying the symmetry result data.

16 Claims, 9 Drawing Sheets

(56) References Cited

U.S. PATENT DOCUMENTS

| | | | | |
|---|---|---|---|---|
| 2017/0304679 | A1 | 10/2017 | Orfield | |
| 2019/0118066 | A1* | 4/2019 | Cardona | A63B 24/0062 |
| 2019/0344115 | A1 | 11/2019 | Neuhaus et al. | |
| 2020/0289890 | A1 | 9/2020 | Kim | |
| 2020/0368581 | A1 | 11/2020 | Cobb | |
| 2021/0016150 | A1 | 1/2021 | Jeong | |
| 2021/0128963 | A1* | 5/2021 | Anderson | A63B 71/0622 |
| 2021/0252336 | A1* | 8/2021 | Dornan | A63B 24/0062 |

OTHER PUBLICATIONS

Examination Report for Application No. GB221366.2 dated Mar. 10, 2023 (1 page).

* cited by examiner

WEIGHTLIFTING SYSTEM AND METHOD FOR ANALYSING LIFT MOTION

PRIORITY

The present application claims priority to Australian Provisional Patent Application No. 2021902204 filed Jul. 17, 2021, entitled Weightlifting System and Method for Analysing Life Motion", the entirety of which is hereby incorporated by reference.

TECHNICAL FIELD

The present technology relates generally to weightlifting and other exercise routines in gymnasia such as for example barbell and dumbbell lifts such as deadlifts, clean and jerk, snatch, and others such as for example kettlebell swinging, free squats and the like.

BACKGROUND ART

The clean and jerk and the snatch are weightlifting exercises that recruit a great number of muscles during their execution. They develop nearly every muscle in the body. The hamstrings, quadriceps, shoulders and back are all engaged. Not only are these exercises Olympic weightlifting events in their own right, the exercises are used by many athletes in many different sports, such as sprinting, swimming, and so on, to develop all kinds of motor skills.

The exercises look easy, but in reality they are difficult; it is easy to cause damage to an athlete with poor technique.

One technique error involves moving the centre of mass of the body around too much, or moving it to the wrong place at the wrong time during the lift.

Known measurement techniques and systems and displays provide overly complex displays, and obtaining data from them is complex and difficult, and the results are of low utility for athletes.

The present inventors seek to provide a new and useful measuring system, a new and useful technique measurement process, a new and useful display for the results.

SUMMARY OF INVENTION

Broadly, the present technology provides a weightlifting system which assesses the symmetry of a user's weightlifting action before and during a lift, pull or push action and provides an alert if the symmetry is outside a selected threshold.

Broadly, the present technology provides a display for a weightlifting system which is configured to display the results of a comparison between the loads on each hand or foot of a user relative to a symmetry threshold.

Broadly, the present technology provides a method of taking a symmetry measurement as between hands or feet of a user and comparing the result against a threshold, for display or other kind of alert or notification.

In accordance with one aspect of the present technology there is provided a weightlifting system for monitoring the symmetry of a lift of a weightlifter, the weightlifting system including:

- a platform for supporting a weightlifter during a lift, the platform including one or more support plates which include one or more load sensors;
- a processor in data communication with the one or more load sensors for receiving and processing weightlifter load data, the processor configured to assess weightlifter symmetry data against a symmetry threshold to provide a symmetry result; and
- an output module or display for informing the weightlifter of, or displaying, the symmetry result.

In accordance with another aspect of the present technology there is provided a method for monitoring the symmetry of a lifting stance of a weightlifter, the method including the steps of:

- receiving in a processor, data from one or more load sensors on one or more support plates on a weightlifting platform to process weightlifter load data;
- processing weightlifter load data to provide weightlifter symmetry data;
- assessing, in a processor, weightlifter symmetry data against a symmetry threshold to provide symmetry result data; and
- displaying or otherwise notifying the weightlifter of the symmetry result data.

In accordance with still another aspect of the present technology, there is provided a weightlifting system for monitoring the symmetry of a weightlifting action of a weightlifter, the weightlifting system including:

- an apparatus for measuring symmetry of hand or foot or leg force, the apparatus including:
  - a plurality of handles or handle adaptors for mounting on a dumbbell, barbell, crank or other handle or drive portion of an exercise device, the plurality of handles or handle adaptors including one or more load sensors;
  - a processor in data communication with the one or more load sensors for receiving and processing handle load data, the processor configured to assess handle loading symmetry data against a symmetry threshold to provide a symmetry result; and
  - an output module or display for informing the weightlifter of, or displaying, the symmetry result.

In accordance with another aspect of the present technology there is provided a method for monitoring the symmetry of a lifting stance of a weightlifter, the method including the steps of:

- receiving in a processor, data from one or more load sensors on one or more handles or handle adaptors on a weightlifting machine or dumbbell or barbell to process weightlifter load data;
- processing handle load data from each handle to provide handle load symmetry data;
- assessing, in a processor, handle load data against a symmetry threshold to provide symmetry result data; and
- displaying or otherwise notifying the weightlifter of the symmetry result data.

The display could be any kind of display or notification module. The notification module could be an amplifier and a loudspeaker. There could be a speech processor provided, or an alert tone generator, to notify the weightlifter of dangerous lifting stance or conditions.

In one embodiment the notification module is a vibration module which causes a portion of the weightlifting platform to vibrate, depending on the processor assessment of the weightlifter symmetry data against the threshold. For example, the vibration module may vibrate at least a portion of the left support plate in a selected pattern if the weightlifter is leaning too far left. Similarly the vibration module may vibrate at least a portion of the right-hand support plate if the weightlifter is leaning too far to the right during or before a lift. Similarly the vibration module could vibrate a front portion of one or more of the support plates to indicate that the weightlifter is leaning too far forward.

The display could be any kind of monitor, including LED, LCD, or other powered panel display.

In one embodiment the display is an LCD monitor.

In one embodiment the display is 10.1 inches in size.

In one embodiment the display is a touch screen.

In one embodiment the weightlifting platform includes a unitary product with integrated display and support plate or plates.

In one embodiment the platform includes a housing with a top surface, a base surface, opposed side and end walls.

In one embodiment the one or more support plates are disposed flush with the top surface of the weightlifting platform.

In one embodiment the platform is 1 m×1 m when in plan view.

In one embodiment the support plates are approximately 50 cm×50 cm in plan view.

In one embodiment the handles are configured to mount on a crank or other lever of a weightlifting machine.

In one embodiment the handle adaptors are sleeves adapted to mount over one or more handles on the crank or other lever of a weightlifting machine.

In one embodiment the handles or handle adaptors are configured to mount over a foot actuator on a weightlifting or other exercise machine.

In one embodiment the handles or handle adaptors are pads configured to mount over a leg actuator on a weightlifting or other exercise machine.

In one embodiment one or more of the handles or handle adaptors include a processor so as to receive force data from the load cells.

In one embodiment the one or more handles or handle adaptors include wireless networking modules so as to transmit load data from one handle or handle adaptor to the other handle or handle adaptor, or to a mobile device or haptic module or display module for processing or display.

In one embodiment the display is flush with the top surface of the weightlifting platform.

In one embodiment the display is flush with the outer surface of one or more of the handles.

In one embodiment the display is one or more LED lights on each handle or handle adaptor.

In one embodiment the display may be hinged or otherwise angled to provide a different or variable viewing angle relative to the top surface.

The processor could be any kind of suitable processor, including a PLC, or other suitable microprocessor. The processor could even be onboard a mobile device owned and/or operated by the weightlifter in order to provide the symmetry calculations and assessment. In that arrangement the data would be transferred to the mobile phone using a wireless module such as a Wifi module and/or a Bluetooth module.

In one embodiment there is a Wifi and Bluetooth module provided in the form of an Espressif ESP-32-WROOM-32E.

In one embodiment the processor is a Raspberry Pi.

In one embodiment the processor is a Raspberry Pi 4B since that can readily mount on the back of a large touch screen monitor in a case with just wires running down to load cells, it has a 64 bit, 1.5 GHz, ARMv6 CPU, there are Multiple input and output ports, a 2G 4G 8G RAM version are available, and 40 GPIO pins can connect to the custom PCB using SD card, and has WiFi and Bluetooth module integrated on the board. There is also a DSI display port to avoid using HDMI cable.

In one embodiment there is provided a Raspberry Pi Zero W, which includes a powerful 1 GHz, single-core ARMv6 CPU, two USB ports, an SD card port and has WiFi and Bluetooth module integrated on the board.

In one embodiment there is provided an onboard power supply to power the processor and load sensors and other accessories.

In one embodiment there is provided one or more ports to facilitate charging the onboard power supply.

In one embodiment there is provided one or more data communication ports on the housing.

In one embodiment the data communication ports are USB, HDMI and the like.

The load sensors may be selected from the group consisting of: 0615-0200-G000-RS(Tedea Huntleigh); 060-0238-05(Honeywell); FC2311-0000-0250-L(TE Connectivity); Tal220 load cell straight Bar; Inline load cell; Vertical load, circular cell SEN-13332(200); Cantilever cell TAL240 (75 and 150).

In one embodiment the method further includes the step of recording load from each plate over a selected period of time for display on a line graph.

In one embodiment the method further includes the step of recording the times, and/or the amount of time that the weightlifter symmetry data was within and without threshold limits.

In one embodiment the system includes a database which stores data relating to height, weight, exercise, dumbbell mass.

In one embodiment the method includes accessing the database to calculate centre of mass projected onto the platform.

In one embodiment the method includes a calculation of centre of mass projected onto the platform.

In one embodiment the processor is configured to record a trajectory of the centre of mass projected onto the platform over time.

In one embodiment the method includes the step of recording the centre of mass projected onto the platform over time.

DESCRIPTION OF EMBODIMENTS

Figure 1:
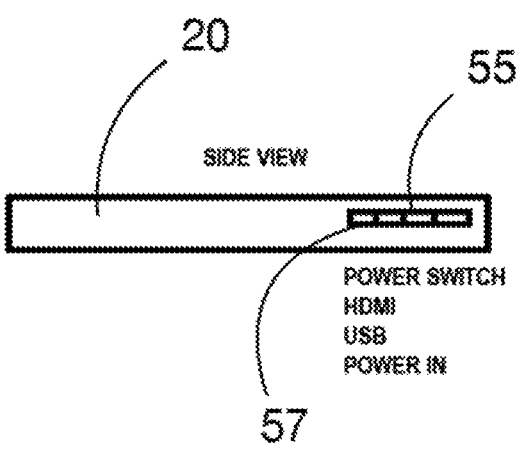
FIG. 1 is a side elevation view of an embodiment of a weightlifting platform.

Referring to the drawings there is shown a weightlifting system generally indicated at 10 for monitoring the symmetry of a stance of a weightlifter during a lift. The system 10 includes a weightlifting platform 20 for supporting the weightlifter during the lift, one or more support plates 30, 32, mounted on a plurality of load sensors 40, the load sensors 40 connected to a processor 50 for processing the load information. There is provided a display 60 integrated with the weightlifting platform 20 and in data communication with the processor 50 so that the processor 50 can output its results there, conveniently in the field of vision of the weightlifter.

Figure 2:
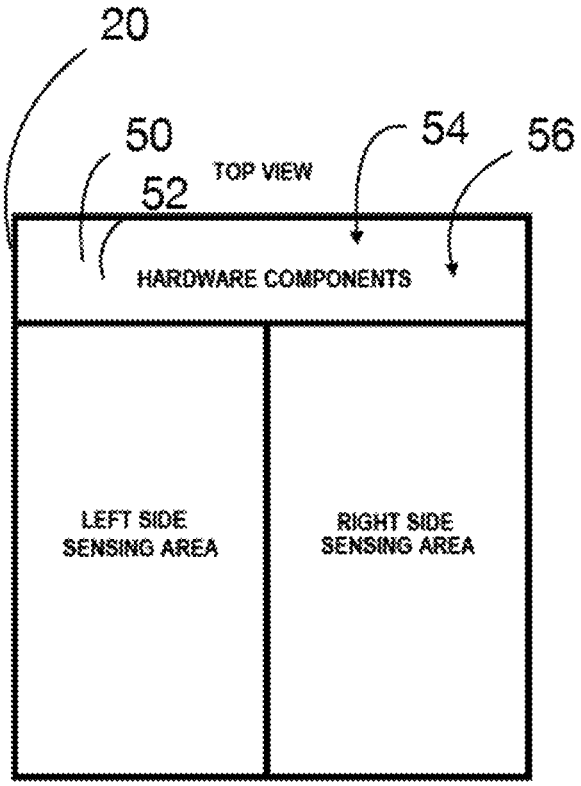
FIG. 2 is a plan view of the weightlifting platform of FIG. 1.
Figure 3:
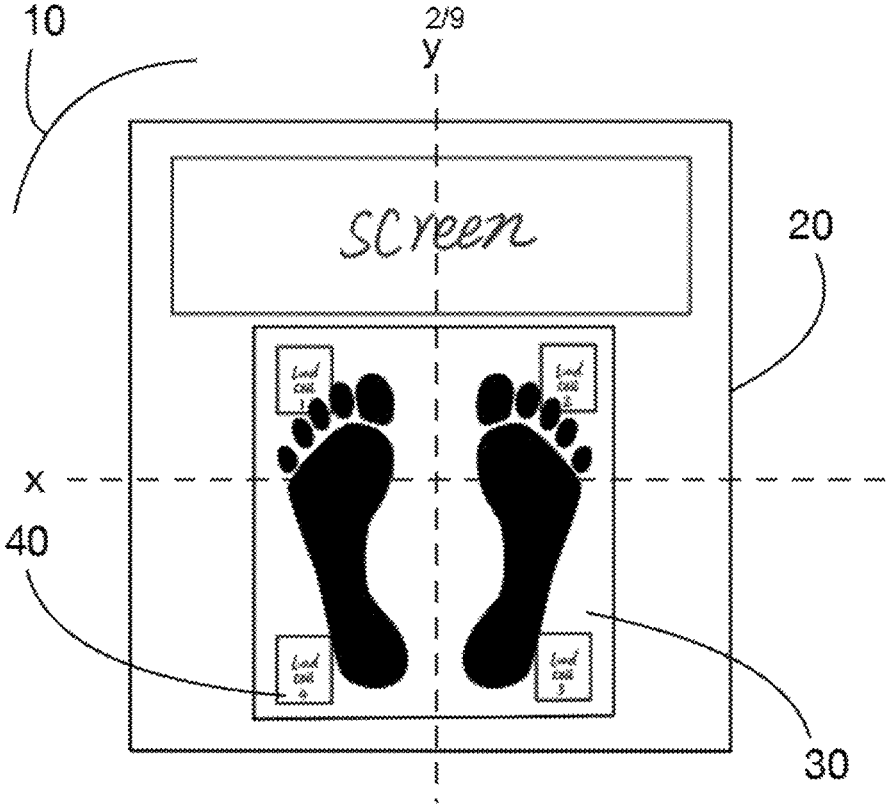
FIG. 3 is a plan view of another embodiment of weightlifting platform.
Figure 4:
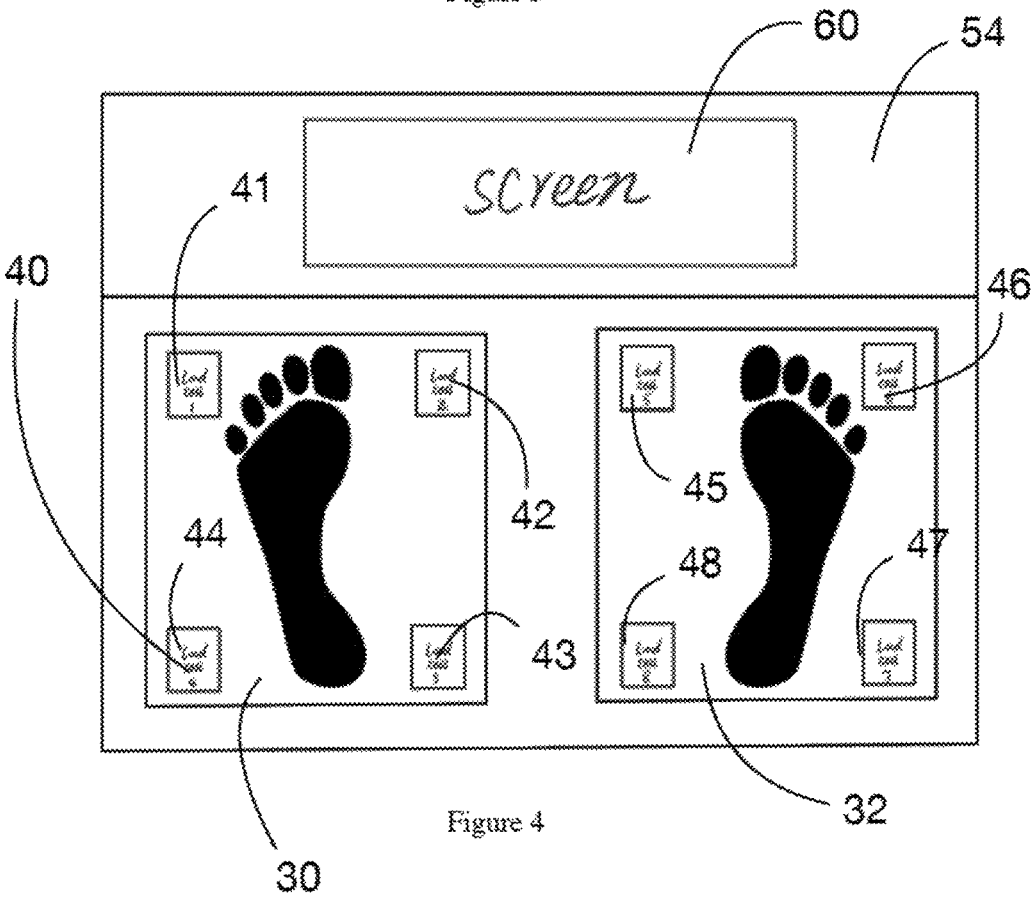
FIG. 4 is a plan view of still another embodiment of weightlifting platform.

The weightlifter's stance could be out of symmetry relative to a y-axis or an x-axis (shown in FIG. 2). The processor 50 is configured to receive data from the plurality of load sensors 40 and to assess the symmetry of the stance of the weightlifter before and during a lift or an exercise. The processor 50 is configured to provide a real-time assessment of the symmetry of the stance and display on the display 60, real-time qualitative and/or quantitative assessment results to inform the weightlifter whether it is safe to proceed with a lift, one or more discrete stages during the lift, or continually during the lift or exercise.

The assessment of symmetry is carried out in the processor 50 by comparing the loads on corresponding load sensors on one or more of the plates 30, 32. For example, the load data on the left plate 30 could be compared with the load data on the right plate 32 to get a left-right symmetry measurement quantity, and then the left-right symmetry measurement quantity is compared with a threshold to provide real-time, rapid and meaningful data on the display 60 to the weightlifter who is about to lift, or is in the process of lifting. To provide front-and-rear symmetry evaluation, the load data on the front of the one or more plates 30, 32 is compared to the load data on the rear of the one or more plates 30, 32.

There are provided eight load sensors 41, 42, 43, 44, 45, 46, 47 and 48. The load sensors 40 are disposed in corner regions of the weight plates 30, 32 so that the processor 50 can assess the symmetry and/or centre of mass of the weightlifter during the lift or exercise. The symmetry could be fore-and-aft, or left-and-right.

A memory 51 and a database 52 may be provided, associated with the processor 50. When calculating the centre of mass of the weightlifter during an exercise, the processor 50 calls data from the database 52 so that various inputs can be taken into account in certain centre-of-mass calculation algorithms. For example, some exercises commence with the weightlifter's body crouched low to the ground, such as a deadlift. Some other exercises call for the weightlifter's body to be crouched low in a different way, or even standing. These inputs from the database can be used to weight various inputs from certain ones of the load sensors 40 during a lift. Other inputs can be entered into the database via the GUI on the display 60, which could be mass and height of the weightlifter, age, and other quantities. In other options, the personal data of the weightlifter could be entered into the processor database 52 wirelessly by using a wireless module 54.

The processor 50 could be any kind of suitable processor, including a PLC, or other suitable microprocessor. The processor 50 could even be onboard a mobile device owned and/or operated by the weightlifter in order to provide the symmetry calculations and assessment. In that arrangement the data would be transferred to the mobile phone using a wireless module such as a Wifi module and/or a Bluetooth module 54.

The Wifi and Bluetooth module 54 is in the form of an Espressif ESP-32-WROOM-32E.

The processor 50 is a Raspberry Pi, either a Raspberry Pi 4B since that can readily mount on the back of a large touch screen monitor in a case with just wires running down to load cells, it has a 64 bit, 1.5 GHz, ARMv6 CPU, there are Multiple input and output ports, a 2G 4G 8G RAM version are available, and 40 GPIO pins can connect to the custom PCB using SD card, and has WiFi and Bluetooth module integrated on the board. There is also a DSI display port to avoid using HDMI cable. Alternatively the Raspberry Pi could be a Raspberry Pi Zero W, which includes a powerful 1 GHz, single-core ARMv6 CPU, two USB ports, an SD card port and has WiFi and Bluetooth module integrated on the board.

An onboard power supply 56 is provided to power the processor and load sensors and other accessories. There is also provided one or more ports 55 to facilitate charging the onboard power supply 56. One or more data communication ports 57 are provided on the housing 20, being USB, HDMI and others that are suitable.

The load sensors 40 may be any one of: 0615-0200-G000-RS (Tedea Huntleigh); 060-0238-05 (Honeywell); FC2311-0000-0250-L (TE Connectivity); Tal220 load cell straight Bar; Inline load cell; Vertical load, circular cell SEN-13332 (200); Cantilever cell TAL240 (75 and 150).

Advantages

Advantageously, the system and method provide a real-time qualitative and quantitative assessment on a display or other notification device as to whether the symmetry of a stance makes it safe to proceed with a lift or exercise, at any point during the lift or exercise.

Furthermore, the system and method provide a symmetry assessment GUI on a display which is integrated with a weightlifting platform, which provides real-time feedback and assessment of technique in the field of vision (or within the reach of other senses such as the ears, or touch) of the weightlifter during a lift to reduce the likelihood of injury.

Example One

A user approaches the weightlifting platform 20 to perform a lift or exercise.

The weightlifter taps the platform on the weightlifting plates 30, 32 and/or on the TARE button 25. The weightlifting system switches on and tares the load cells 40.

The taring process is in detail: Once powered on, the processor 50 causes the GUI on the display 60 to settle on a home screen showing a trade mark for the system.

The processor 50 then causes the system to settle into idle mode, in which the weightlifter will press the support plates 30, 32 once each, and remove all mass from the support plates 30, 32. After this press of the plates 30, 32, the processor 50 will cause the system to calibrate or tare to 0 kg unloaded, in similar fashion to bathroom scales.

Once the system has calibrated or tared to 0 kg the weightlifter can then stand on plates 30, 32 and display 60 will show instantaneous static split between left and right leg and total mass.

The weightlifter may then leave the plates 30, 32 to retrieve the intended loaded barbell and stand back on plates 30, 32. The processor 50 will cause the display 60 to display a lifting screen (FIGS. 5, 8 and 9) which comprises:

- a histogram of the comparison of the load on each foot,
- a numeral which is the quantum of load on each foot at 94, and
- a total quantity 95 which is a combined mass of weightlifter and intended weight to lift.

Figure 5:
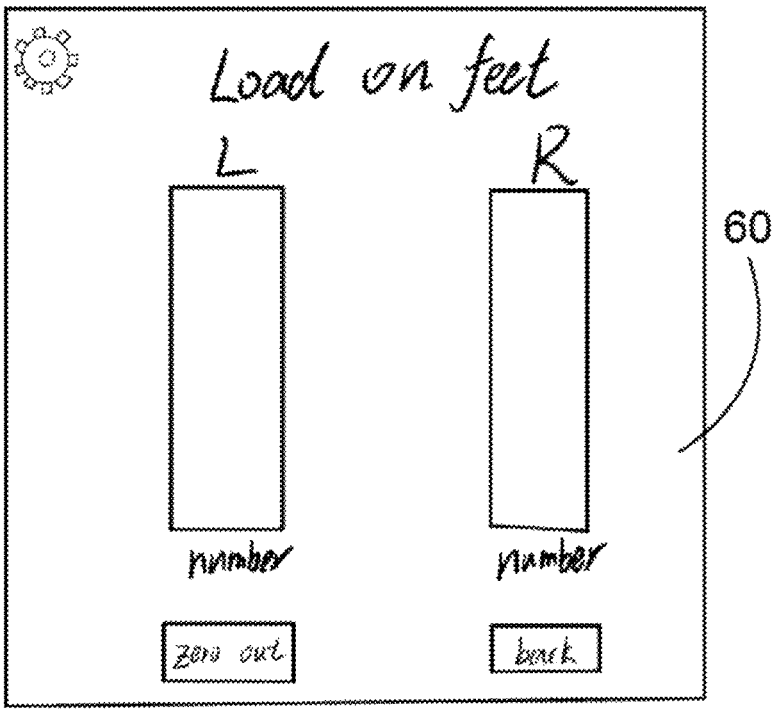
FIG. 5 is a GUI on a display on the weightlifting platform showing auto-scaling histogram of load on each foot of a weightlifter.
Figure 8:
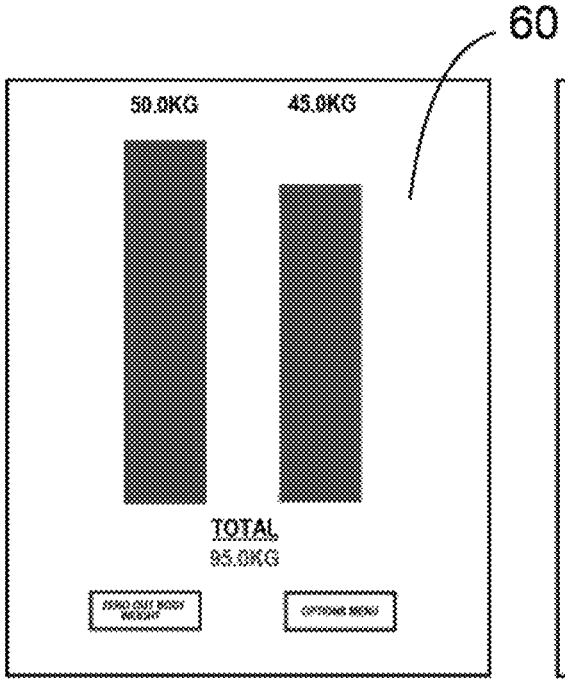
FIG. 8 is a GUI on a display on the weightlifting platform showing an alert that a symmetry threshold has been exceeded by the weightlifter.
Figure 9:
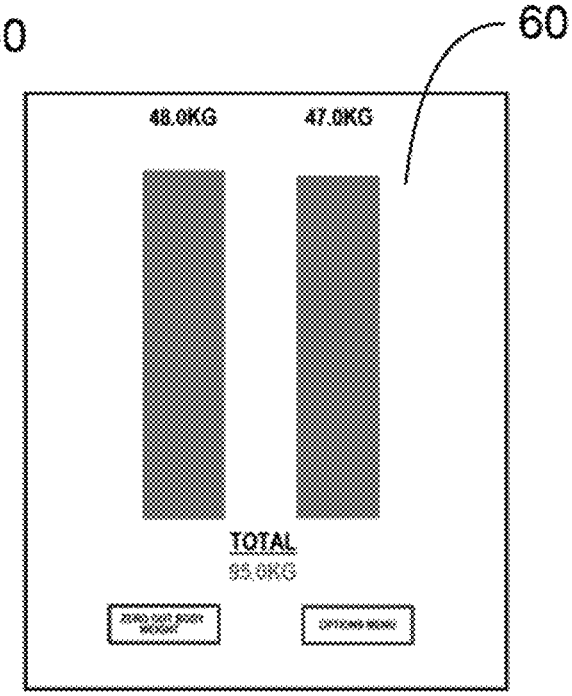
FIG. 9 is a GUI on a display on the weightlifting platform showing a notification that the weightlifter's weight distribution is below a symmetry threshold.
Figure 10:
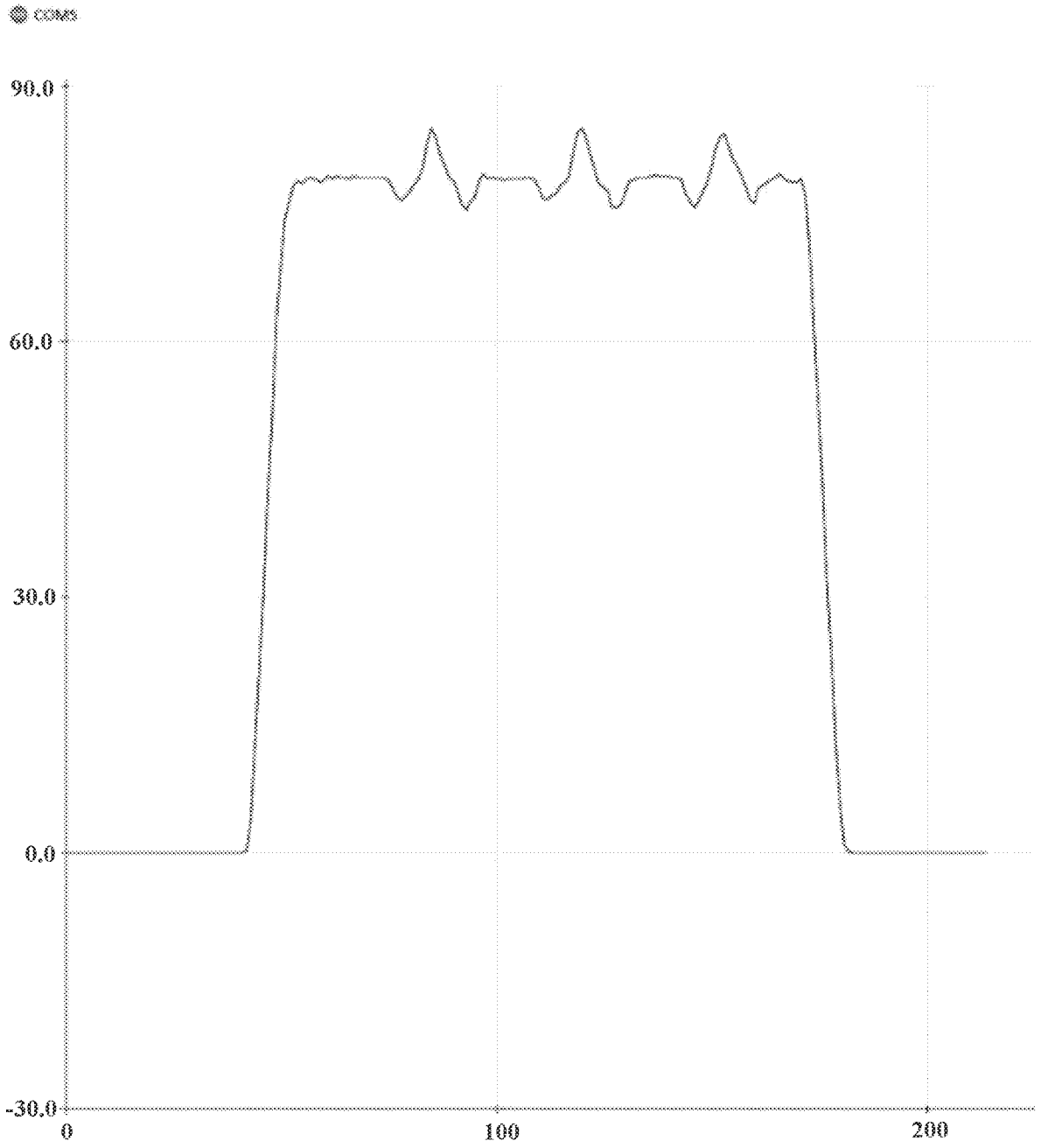
FIG. 10 is a trace of a load on a weightlifting platform during three squat lifts.
Figure 11:
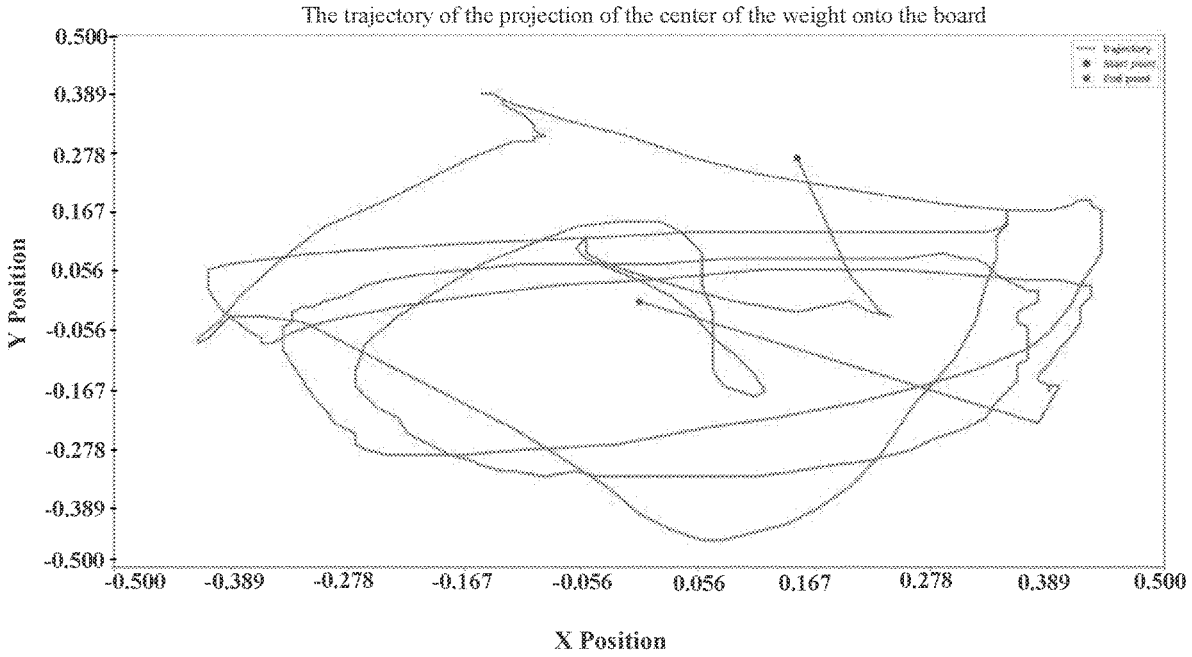
FIG. 11 is a trace of a projection of a centre of gravity onto a weightlifting platform during a test, demonstrating the kind of raw data that can be extracted from the load cells and processed by the processor which can then convert to the trace shown in FIG. 6.

The histograms 90, 91 shown in FIGS. 5, 8 and 9 are caused to be displayed by the processor 50 on the display 60. The processor 50 causes an auto-scaling histogram to be shown as shown in FIGS. 5, 8 and 9. Below the histogram is a numeral which is a quantity of total mass across both feet. As regards auto scaling, this means that the histogram may not necessarily show its base, but rather, for clarity, show the differences in as stark a way as possible. The processor causes the top ten or so percent of the histogram bars to be shown. In that regard, the histogram bars 90, 91 in FIG. 8 are also shown in red when the processor assesses them as being different from one another by more than a selected threshold. In one example, the threshold is 2%. The histogram bars are caused by the processor 50 to be shown in green in FIG. 9 because they are within the threshold (2%) of each other and thus they are in symmetry. Once the histogram bars turn green, the processor causes the GUI to change to a LIFT phase, discussed below.

In an alternative, processor causes a notification module 85 to notify the weightlifter of a situation where his or her bodyweight is out of symmetry using a vibration module 87 which causes a portion of the weightlifting platform to vibrate, depending on the processor assessment of the weightlifter symmetry data against the threshold. For example, the vibration module may vibrate at least a portion of the left support plate 30 in a selected pattern if the weightlifter is leaning too far left. Similarly the vibration module may vibrate at least a portion of the right-hand support plate 32 if the weightlifter is leaning too far to the right during or before a lift. Similarly the vibration module could vibrate a front portion of one or more of the support plates to indicate that the weightlifter is leaning too far forward. This would be done by having a plurality of different vibration units 88 disposed around the weightlifting platform.

When the mass split between left and right has been within 2% (adjustable in firmware) for longer than 3 seconds the processor causes the display to count down such that it will display:

Counting down to weight lift
3 . . .
2 . . .
1 . . .
LIFT

On LIFT, the weightlifter raises the weight into the air by performing a clean and jerk, or snatch, or other exercise, and the screen will show "analysing data" on the display 60.

Figure 6:
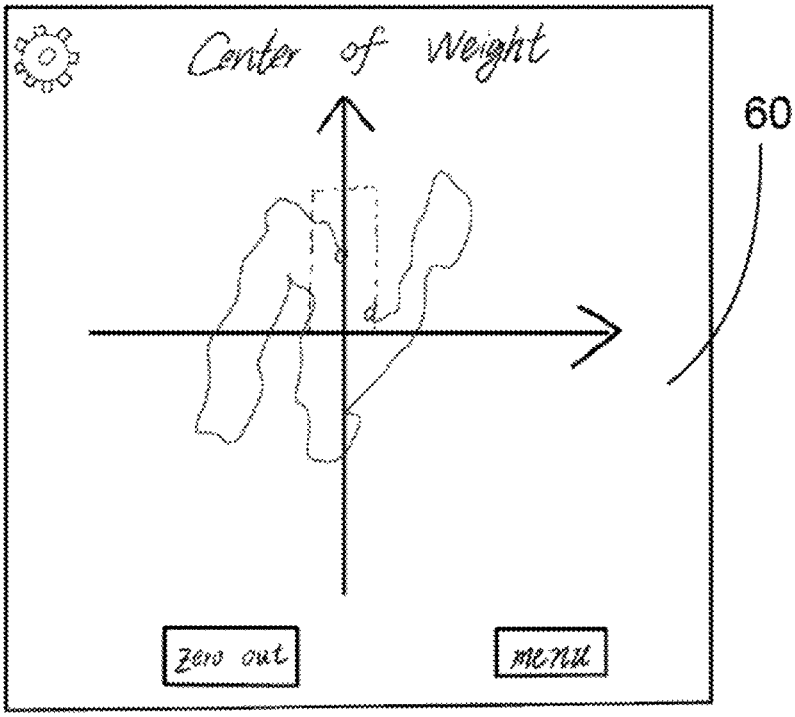
FIG. 6 is a GUI on a display on the weightlifting platform showing a trace over time (during a lift) of a centre of mass of a weightlifter.
Figure 7:
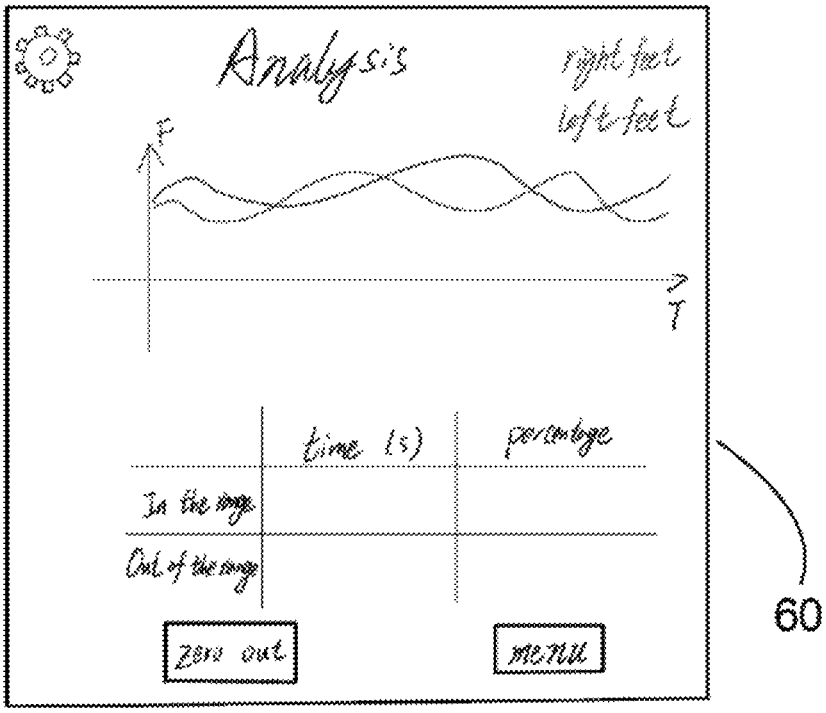
FIG. 7 is a GUI on a display on the weightlifting platform showing an example trace over time of a load on each foot plate over time (during a lift)

Once the processor 50 has completed its analysis, the display 60 will show the following values;

- Time to lift in seconds;
- Peak weight sensed and recorded by the load sensors 40 during lift;
- The split of maximum % difference between support plates 30, 32 and the front and rear load sensors during the lift or exercise;
- time spent within symmetry tolerance and time spent outside of tolerance during the lift and shown in FIG. 7, bottom of display 60;
- graph of raw load on each foot during lift as shown in FIG. 7 (top of display 60);
- A graph of the centre of balance of lift as shown in FIG. 6.

The processor 50 causes the results to remain on display 60 for 5 minutes before returning to idle mode.

When the weightlifter steps off the platform 20 and then immediately back on, the processor 50 will tare the load sensors to 0 kg and the system will reset ready for next value.

An analysis mode can be selected from the display 60 by pressing a menu button 65, and then the processor 50 causes the screen to show the above features on the display 60.

Figure 12:
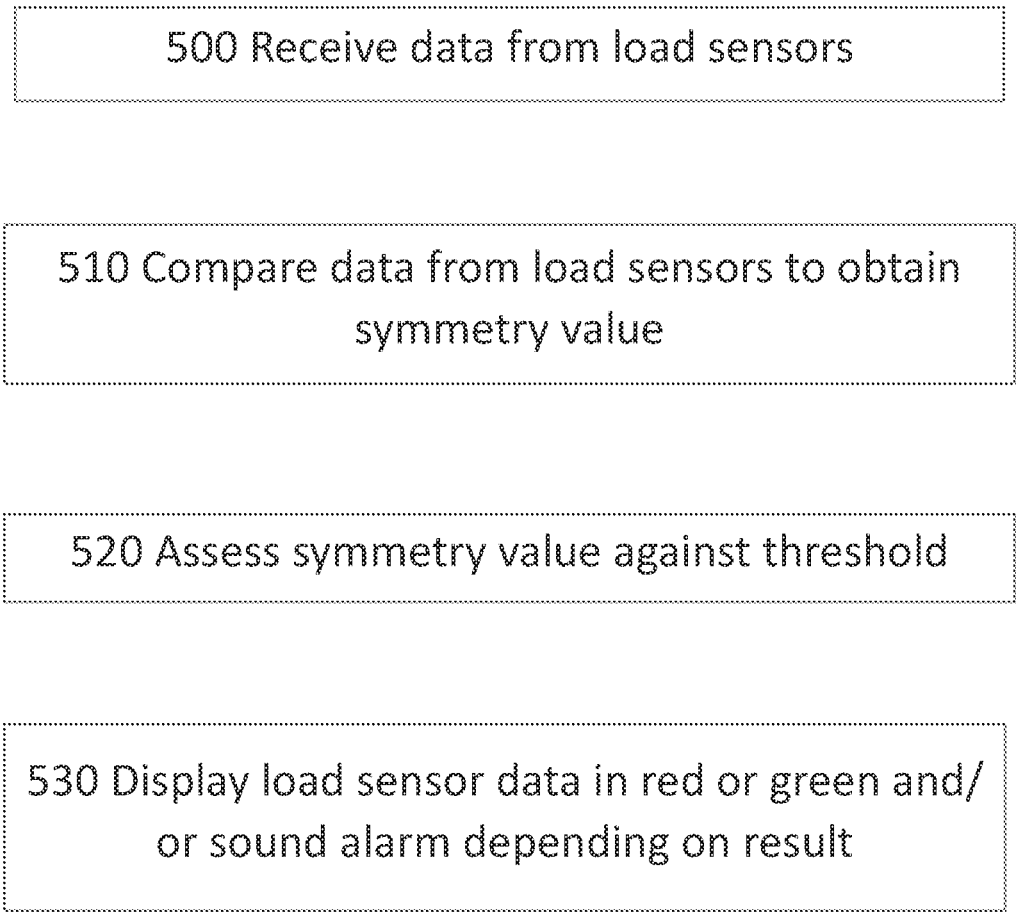
FIG. 12 is a method step flow chart of method steps undertaken by a processor.

Method steps taken by the processor are shown in FIG. 12 in which step 510 is Receive data from the load sensors 40. Step 520 is compare data from load sensors to obtain a symmetry value. Step 530 is compare the symmetry value to a threshold. Step 540 is to display the load data and/or symmetry value in red or green depending on whether the load comparison data is outside a threshold. These steps occur in real time so that the weightlifter can react and amend his or her technique accordingly. The data steps are recorded so that the lift can be analysed later. The data can be extracted and analysed with analysis software via the network module or ports.

Example Two

Figure 13:
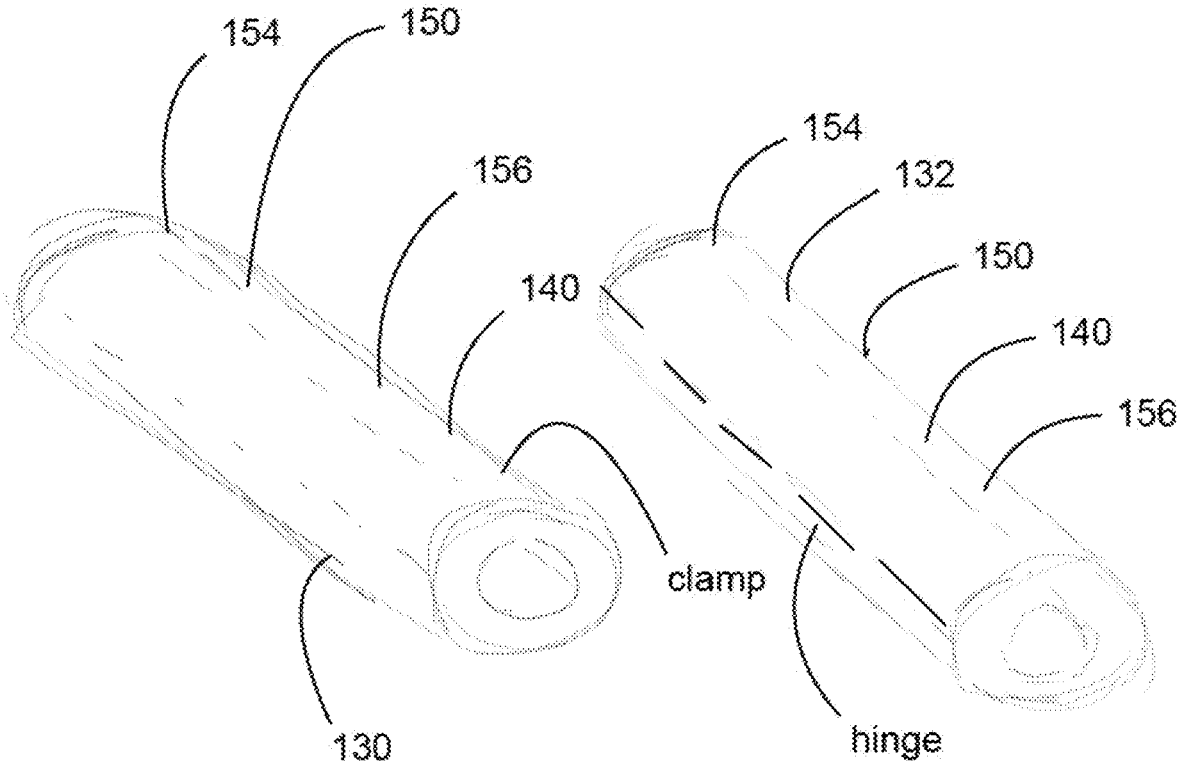
FIG. 13 shows another embodiment of the present technology which is in the form of two handle adaptors which provide monitoring of the symmetry of a weightlifting action, the handles being able to be fitted over a dumbbell, barbell, or weightlifting machine handles.
Figure 14:
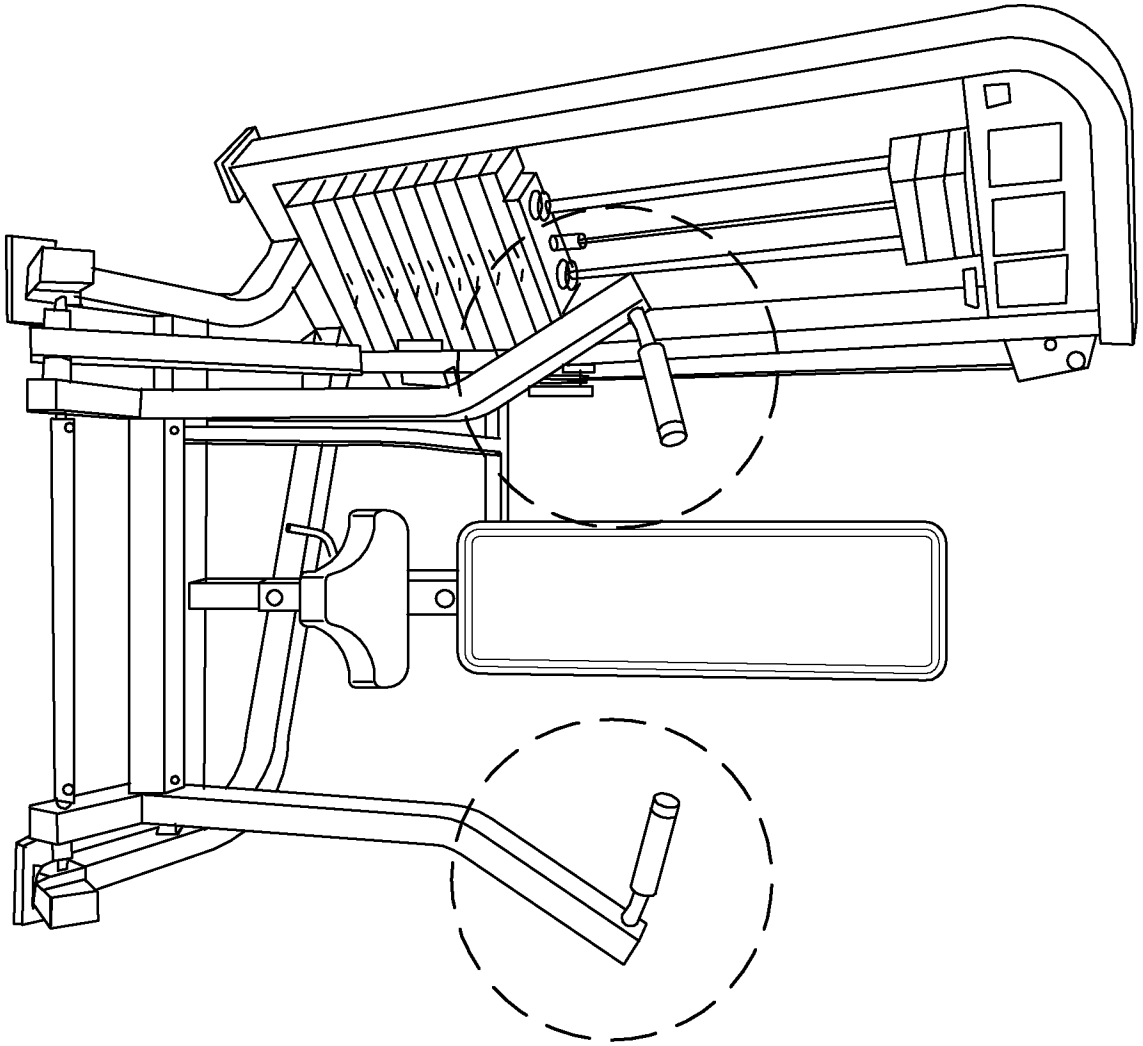
FIG. 14 shows a weightlifting machine with handles that could be replaced or overlaid by the embodiment of FIG. 13.

FIGS. 13 and 14 show another embodiment of the present technology which can be used to assess the symmetry of a lift or a push, or a pull, with the legs or hands of a person conducting exercise with a machine. The machine could be as simple as a barbell, or a pair of dumbbells, or it could be sophisticated like the one in the picture of FIG. 13.

Many of the same elements described above are used to provide a similar result, which is, a symmetry monitor and output result. Thus, in FIG. 13 it can be seen that like numerals denote like components, and so, two sleeves 130 and 132 take the place of the two weight plates 30 and 32. The sleeves 130 and 132 include the electronics described above (load sensors 140, power 156, and processor(s) 150 and wireless module 154), so that they can measure load imparted to them, and also transmit the load data to the other handle for further processing or to a mobile device for display or processing.

The method of FIG. 12 could also be used with the embodiment shown in FIGS. 13 and 14.

The display in FIG. 12 could be a haptic feedback unit for notification, or one or more LEDs.

The sleeve could be hinged so as to form a cuff which can be opened up and then clamped to a dumbbell or barbell. A clamp could be provided.

Other features of the handles are similar to those described above in relation to Example 1. Persons of ordinary skill in the art, once reading those features and steps, are well equipped to understand and make the invention without difficulty.

It will be understood to persons skilled in the art of the invention that many modifications may be made without departing from the spirit and scope of the invention.

It is to be understood that any prior art publication referred to herein does not constitute an admission that the publication forms part of the common general knowledge in the art.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Additional Disclosure

The following clauses are offered as further description of the disclosed invention.

Clause 1. A weightlifting system for monitoring the symmetry of a lifting stance of a weightlifter, the weightlifting system including:

a platform for supporting a weightlifter during a lift and/or handles for measuring hand force, the platform and/or handles including one or more support plates which include one or more load sensors, and/or a plurality of handles or handle adaptors for mounting on a dumbbell, barbell, crank or other handle or drive portion of an exercise device, the plurality of handles or handle adaptors including one or more load sensors;

a processor in data communication with the one or more load sensors for receiving and processing weightlifter load data, the processor configured to assess weightlifter symmetry data against a symmetry threshold to provide a symmetry result; and an output module or display for informing the weightlifter of, or displaying, the symmetry result.

Clause 2. A method for monitoring the symmetry of a lifting stance of a weightlifter, the method including the steps of:

receiving in a processor, data from one or more load sensors on one or more support plates on a weightlifting platform to process weightlifter load data;

processing weightlifter load data to provide weightlifter symmetry data;

assessing, in a processor, weightlifter symmetry data against a symmetry threshold to provide symmetry result data; and displaying or otherwise notifying the weightlifter of the symmetry result data Clause 3. The system or method in accordance with any one of claim 1 or 2 wherein the notification module is a vibration module which causes a portion of the weightlifting platform to vibrate, depending on the processor assessment of the weightlifter symmetry data against the threshold.

Clause 4. The system or method in accordance with any one of claim 1 or 2 wherein the vibration module is configured to vibrate at least a portion of the left support plate in a selected pattern if the weightlifter is leaning too far left, or the vibration module is configured to vibrate at least a portion of the right-hand support plate if the weightlifter is leaning too far to the right during or before a lift, or the vibration module is configured to vibrate a front portion of one or more of the support plates to indicate that the weightlifter is leaning too far forward.

Clause 5. The system or method in accordance with any one of claim 1 or 2 wherein the display is a monitor, including LED, LCD, touch screen, or other powered panel display, or the display is one or more LED lights on each handle or handle adaptor.

Clause 6. The system or method in accordance with any one of claim 1 or 2 wherein the weightlifting platform includes a unitary product with integrated display and support plate or plates.

Clause 7. The system or method in accordance with any one of claim 1 or 2 wherein the platform includes a housing with a top surface, a base surface, opposed side and end walls, and the one or more support plates are disposed flush with the top surface of the weightlifting platform.

Clause 8. The system or method in accordance with any one of claim 1 or 2 wherein the handles are configured to mount on a crank or other lever of a weightlifting machine.

Clause 9. The system or method in accordance with any one of claim 1 or 2 wherein the handle adaptors are sleeves adapted to mount over one or more handles on the crank or other lever of a weightlifting machine, or the handles or handle adaptors are configured to mount over a foot actuator on a weightlifting or other exercise machine, or the handles or handle adaptors are pads configured to mount over a leg actuator on a weightlifting or other exercise machine.

Clause 10. The system or method in accordance with any one of claim 1 or 2 wherein one or more of the handles or handle adaptors include a processor to receive force data from the load cells, and wherein the one or more handles or handle adaptors include wireless networking modules so as to transmit load data from one handle or handle adaptor to the other handle or handle adaptor, or to a mobile device or haptic module or display module for processing or display.

Clause 11. The system or method in accordance with any one of claim 1 or 2 wherein the display is flush with the top surface of the weightlifting platform, or flush with the outer surface of one or more of the handles.

Clause 12. The system or method in accordance with any one of claim 1 or 2 wherein the display is hinged or otherwise angled to provide a different or variable viewing angle relative to the top surface.

Clause 13. The system or method in accordance with any one of claim 1 or 2 wherein the processor is a PLC, Raspberry Pi, Raspberry Pi 4B, Raspberry Pi Zero, or other suitable microprocessor, or a mobile device owned and/or operated by the weightlifter in order to provide the symmetry calculations and assessment.

Clause 14. The system or method in accordance with any one of claim 1 or 2 wherein there is a Wifi and Bluetooth module provided in the form of an Espressif ESP-32-WROOM-32E.

Clause 15. The system or method in accordance with any one of claim 1 or 2 wherein there is provided an onboard power supply to power the processor and load sensors and other accessories, and there is provided one or more ports to facilitate charging the onboard power supply.

Clause 16. The system or method in accordance with any one of claim 1 or 2 wherein there is provided one or more data communication ports on the housing, wherein the data communication ports are USB, HDMI and the like.

Clause 17. The system or method in accordance with any one of claim 1 or 2 wherein the method further includes the step of recording load from each plate over a selected period of time for display on a line graph.

Clause 18. The system or method in accordance with any one of claim 1 or 2 wherein the method further includes the step of recording the times, and/or the amount of time that the weightlifter symmetry data was within and without threshold limits.

Clause 19. The system or method in accordance with any one of claim 1 or 2 wherein the system includes a database which stores data relating to height, weight, exercise, dumbbell mass, and the method includes accessing the database to calculate centre of mass projected onto the platform.

Clause 20. The system or method in accordance with any one of claim 1 or 2 wherein the processor is configured to record a trajectory of the centre of mass projected onto the platform over time.

Clause 21. The method in accordance with any one of claim 1 or 2 wherein the method includes the step of recording the centre of mass projected onto the platform over time.

Clause 22. The method in accordance with any one of claim 1 or 2 further including a monitoring step to assess that the mass split between left and right handles or plates has been within a selected percentage for longer than 3 seconds; and a countdown step wherein the processor causes the display to count down such that it will display:

Counting down to weight lift

3 . . .

2 . . .

1 . . .

LIFT

Clause 23. The method in accordance with any one of claim 1 or 2 wherein there includes an analysis step to analyse symmetry of lift.

Clause 24. The method in accordance with any one of claim 1 or 2 wherein after the analysis step the display is configured to show the following values;

Time to lift in seconds;

Peak weight sensed and recorded by the load sensors during lift;

The split of maximum % difference between support plates and the front and rear load sensors during the lift or exercise;

time spent within symmetry tolerance and time spent outside of tolerance during the lift;

graph of raw load on each foot during lift

A graph of the centre of balance of lift

Clause 25. The method in accordance with any one of claim 1 or 2 the method steps are taken in real time during a lift.

What is claimed is:

1. A weightlifting system for monitoring the symmetry of a lifting stance of a weightlifter, the weightlifting system including:

a platform for supporting a weightlifter during a lift and/or handles for measuring hand force, the platform and/or handles including one or more support plates which include one or more load sensors, and/or a plurality of handles or handle adaptors for mounting on a dumbbell, barbell, crank or other handle or drive portion of an exercise device, the plurality of handles or handle adaptors including one or more load sensors;

a processor in data communication with the one or more load sensors for receiving and processing weightlifter load data, the processor configured to assess weightlifter symmetry data against a symmetry threshold to provide a symmetry result;

an output module or display for informing the weightlifter of, or displaying, the symmetry result; and a notification module for notifying the weightlifter based on the symmetry result;

wherein the notification module comprises a vibration module which causes a portion of the weightlifting platform to vibrate, depending on the processor assessment of the weightlifter symmetry data against the symmetry threshold;

wherein the vibration module is configured to vibrate at least a portion of the left support plate in a selected pattern if the weightlifter is leaning too far left, or the vibration module is configured to vibrate at least a portion of the right-hand support plate if the weightlifter is leaning too far to the right during or before a lift, or the vibration module is configured to vibrate a front portion of one or more of the support plates to indicate that the weightlifter is leaning too far forward.

2. The system of claim 1 wherein the display is a monitor including LED, LCD, touch screen, or other powered panel display, or the display is one or more LED lights on each handle or handle adaptor.

3. The system of claim 1 wherein the platform includes a unitary product with an integrated display and one or more support plates.

4. The system of claim 1 wherein the platform includes a housing with a top surface, a base surface, and opposed side and end walls, and the one or more support plates are disposed flush with the top surface of the weightlifting platform.

5. The system of claim 1 wherein the handles are configured to mount on a crank or other lever of a weightlifting machine.

6. The system of claim 1 wherein the handle adaptors are sleeves adapted to mount over one or more handles on the crank or other lever of a weightlifting machine, or the handles or handle adaptors are configured to mount over a foot actuator on a weightlifting or other exercise machine, or the handles or handle adaptors are pads configured to mount over a leg actuator on a weightlifting or other exercise machine.

7. The system of claim 1 wherein one or more of the handles or handle adaptors include a processor to receive force data from the one or more load sensors, and wherein the one or more handles or handle adaptors include wireless networking modules so as to transmit load data from one handle or handle adaptor to another handle or handle adaptor, or to a mobile device or haptic module or display module for processing or display.

8. The system of claim 1 wherein the display is flush with the top surface of the weightlifting platform, or flush with an outer surface of one or more of the handles.

9. The system of claim 1 wherein the display is hinged or otherwise angled to provide a different or variable viewing angle relative to the top surface.

10. The system of claim 1 wherein there is provided an onboard power supply to power the processor and the one or more load sensors and other accessories, and wherein there is provided one or more ports to facilitate charging the onboard power supply.

11. The system of claim 1 wherein there is provided one or more data communication ports on the housing, wherein the data communication ports are USB, HDMI and the like.

12. The system of claim 1 further comprising a database which stores data relating to height, weight, exercise, and dumbbell mass, and wherein the processor is configured to access the database to calculate a centre of mass projected onto the platform.

13. The system in accordance with claim 1 wherein the processor is configured to record a trajectory of the centre of mass projected onto the platform over time.

14. A method for monitoring the symmetry of a lifting stance of a weightlifter, the method including the steps of:

receiving in a processor, data from one or more load sensors on one or more support plates on a weightlifting platform to process weightlifter load data;

processing weightlifter load data to provide weightlifter symmetry data;

assessing, in the processor, the weightlifter symmetry data against a symmetry threshold to provide symmetry result data; and notifying the weightlifter of the symmetry result data using a notification module;

wherein the notification module comprises a vibration module which causes a portion of the weightlifting platform to vibrate, depending on the processor assessment of the weightlifter symmetry data against the symmetry threshold;

wherein the vibration module is configured to vibrate at least a portion of the left support plate in a selected pattern if the weightlifter is leaning too far left, or the vibration module is configured to vibrate at least a portion of the right-hand support plate if the weightlifter is leaning too far to the right during or before a lift, or the vibration module is configured to vibrate a front portion of one or more of the support plates to indicate that the weightlifter is leaning too far forward.

15. The method of claim 14 further comprising the step of recording load from each support plate over a selected period of time for display on a line graph.

16. The method of claim 14 further comprising the step of recording times, and/or an amount of time that the weightlifter symmetry data was within and without threshold limits.

* * * * *